US005847512A

United States Patent [19]

Baba et al.

[11] Patent Number: 5,847,512

[45] Date of Patent: Dec. 8, 1998

[54] LAMP DEVICE AND A DISPLAY APPARATUS USING THE SAME

[75] Inventors: Masaharu Baba; Teiji Shimokawa; Yoshiaki Hara, all of Yokohama, Japan

[73] Assignee: Toshiba Lighting and Technology Corporation, Tokyo, Japan

[21] Appl. No.: 943,940

[22] Filed: Sep. 30, 1997

[30] Foreign Application Priority Data

Sep. 30, 1996 [JP] Japan ..... 8-258019
Dec. 27, 1996 [JP] Japan ..... 8-350973

[51] Int. Cl.[6] ..... H05B 37/00

[52] U.S. Cl. ..... 315/51; 315/71; 315/72; 362/800

[58] Field of Search ..... 362/800, 226; 315/51, 71, 72, 74, 200 R, 209 R, 241 S, 241 P, 52

[56] References Cited

U.S. PATENT DOCUMENTS 5,017,833 5/1991 Clarke et al. ..... 315/51

*Primary Examiner*—Benny T. Lee
*Assistant Examiner*—David H. Vu
*Attorney, Agent, or Firm*—Pillsbury Madison & Sutro LLP

[57] ABSTRACT

A lamp device is constituted by an assembly consisting of a holder and a lamp and can be detachably attached to an installation hole of a print board or the like. The lamp device internally includes a flickering circuit for flickering the lamp. The holder comprises first, second, and third contact members for electrically connecting a power supply terminal of the print board with the lamp, and a flickering circuit element is contained in the holder. The first contact member has contacts with the power supply terminal and with a lead of the lamp. The second contact member has contacts with another lead of the lamp and with a terminal of the flickering circuit element. The third contact member has contacts with another terminal of the flickering circuit element and the power supply terminal.

16 Claims, 9 Drawing Sheets

LAMP DEVICE AND A DISPLAY APPARATUS USING THE SAME

BACKGROUND OF THE INVENTION

The present invention relates to a lamp device used in a display apparatus such as an instrument panel of a vehicle like a car, a display apparatus for home-use electronics, or the like, and the display apparatus thus using the lamp device.

More specifically, the present invention relates to a lamp device which integrates a lamp and a holder attachable to a board or the like and which is constructed by an assembly consisting of the holder and the lamp so as to contain a circuit component like a flicker circuit for the lamp, and also relates to a display apparatus using the lamp device.

A lamp device formed as an assembly integrating a lamp and a holder has been known as a conventional lamp device used in a display apparatus in home-use electric products and other various devices. This lamp device can be mechanically engaged and held in an installation hole formed in a print board or the like provided on a back-surface of a display apparatus, and an electric connection between the lamp and a circuit on the print board is obtained by a connect portion having contact points provided on the holder upon attachment of the lamp device. Thus, this lamp device is constructed such that the device can be easily attached and replaced.

Meanwhile, this kind of conventional lamp device is kept continuously lightened when an electric power is supplied through a circuit on a print board or the like described above. When supply of the power is stopped, the lamp is turned off. However, for some applications of a lamp device, a flickering type in which a lamp is repeatedly turned on and off in a short cycle may rather be advantageous than the lamp device as described above. Flickering of a lamp in a short cycle makes an effect of attracting large attention from observers and is therefore suitable for display of a warning. Further, the level of effectiveness in attracting an attention from observers can be set by appropriately arranging the time cycle of flickering, the ratio of the turning-on time to the turning-off time, and other conditions. This means, it is possible to issue various warnings of different levels, such as, a strong warning, a warning of a lower level, and the like.

In a conventional display apparatus, flickering of a lamp in a short cycle is achieved by incorporating a flickering circuit for the lamp into a control circuit for controlling the display device. However, there has been a problem that the control circuit of the display apparatus is complicated and has a large size because such a flickering circuit must be additionally incorporated. In addition, as described above, since the effectiveness of attracting an attention from observers varies, depending on how the lamp flickers, there is a case that the mode and way of flickering of the lamp must be changed after production of a display apparatus is once completed. However, since a conventional lamp device uses a flickering circuit incorporated in a control circuit of a display apparatus, the control circuit of the display apparatus itself must be modified or replaced with another one, and thus, there are difficulties in changing the mode and way of flickering.

In many cases, conventional lamp devices as described above use incandescent lamps. For example, Japanese Utility Model Application KOKOKU Publication No. 7-22068 discloses this kind of lamp device using an incandescent lamp. However, an incandescent lamp has a short life-time and involves heat emission. An incandescent lamp is therefore not suitable for a light source.

In order to solve this problem, some lamp devices adopt LEDs as lamps. An example of a lamp device using an LED as a light source is disclosed in Japanese Utility Model Application KOKOKU No. 6-17326. An LED does not generate heat and has a long life-time and is highly reliable. However, an LED has electric polarities which causes a possibility that polarities of an LED are mistaken when assembling an LED and a holder.

BRIEF SUMMARY OF THE INVENTION

The present invention has an object of solving problems as described above. In order to achieve the object, the present invention is firstly characterized in that a circuit for flicking a lamp is included in a lamp device having a lamp and a holder.

According to the above structure, when an electric power is supplied to the lamp device, the flickering circuit makes the lamp flicker in a short cycle, so that large attention can be attracted from observers. In addition, a control circuit of a display apparatus using the lamp device needs not be additionally provided with a flickering circuit for the lamp, so that the control circuit can have a simple structure and a small size. In addition, if the flickering cycle or the ratio of the turning-on time to the turning-off time should be changed after this kind of display apparatus is once manufactured, it is only necessary to replace the lamp device with another lamp device having a different flickering circuit, so that the variation of the lamp device can be easily changed. In addition, this kind of lamp device can be used in a conventional display apparatus.

According to a preferred embodiment of the present invention, the holder is provided with a flange portion and an engaging projecting portion for mechanically installing the lamp device on a print board or the like, and is also provided with a connecting member for electrically connecting the power supply circuit of the print board with a lamp. Further, a concave portion is formed in the holder and a base end portion and a flickering circuit are contained in the concave portion. One of the chambers contains the base end portion of the lamp and the other chamber contains a flickering circuit.

In addition, according to another preferred embodiment of the present invention, a LED or another kind of light source is used as the lamp. Further, the holder contains a turning-on circuit and/or a flickering circuit for the LED. According to further another preferred embodiment, a base end portion of the LED is equipped with a small size circuit board on which a turning-on circuit and/or a flickering circuit is installed. An insertion hole in which the circuit board and the base end portion of the LED are inserted and held is formed.

According to further another preferred embodiment, the circuit board is provided, deviated from the center axis line of a light source such as a LED described above which has polarities. In addition, guide grooves for insertion of the circuit board are formed in the insertion hole of the holder, so as to correspond to the deviation of the circuit board. Therefore, only when the assembly of the LED and the circuit board has a predetermined positional relationship with respect to the holder, the circuit board can be inserted in the guide grooves. The assembly of the LED and the circuit board cannot be attached to the socket, with the polarities inverted and therefore, wrong insertion of the assembly is prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

Figure 1:
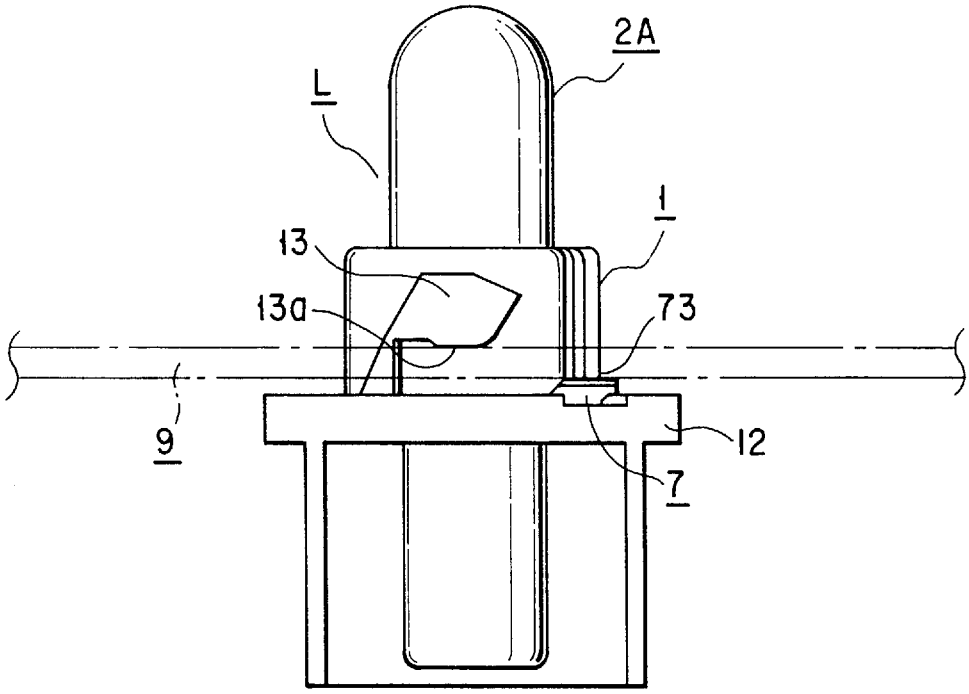
FIG. 1 is a side view of a lamp device according to a first embodiment of the present invention.
Figure 2:
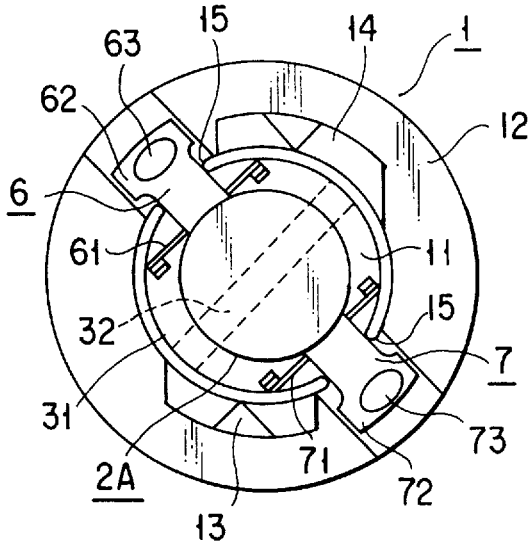
FIG. 2 is a plan view of the lamp device shown in FIG. 1.
Figure 3:
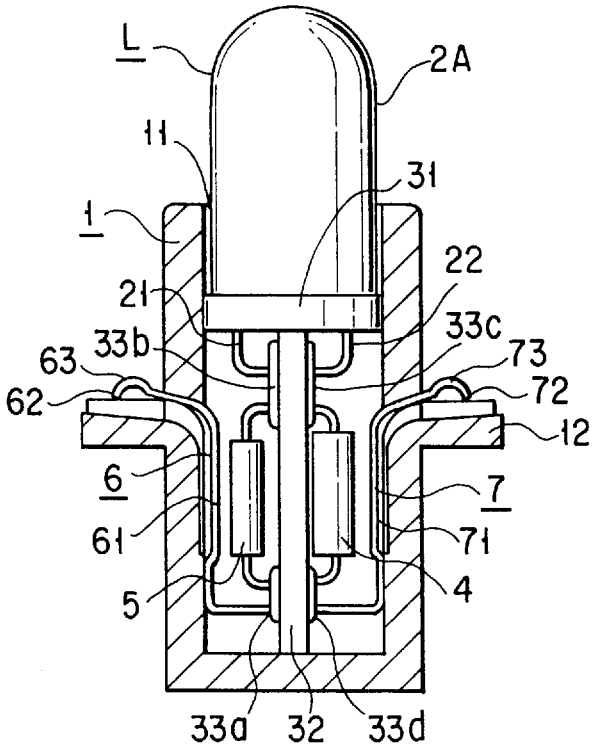
FIG. 3 is a longitudinal cross-sectional view of the lamp device shown in FIG. 1.
Figure 4:
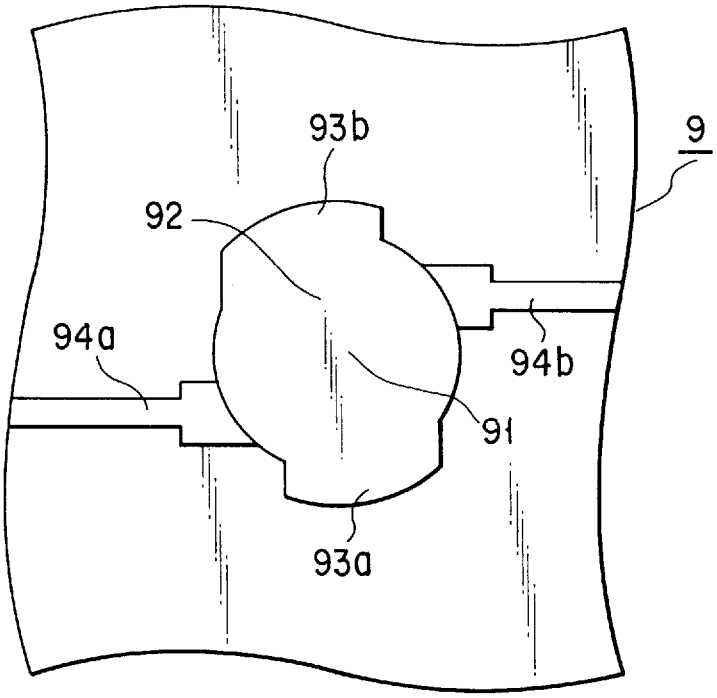
FIG. 4 is a plan view showing a part of a wiring board to which the lamp device shown in FIG. 1 is attached.

In the following, embodiments of the present invention will be explained. FIGS. 1 to 4 show a lamp device according to a first embodiment of the present invention. This lamp device is a lamp device L which is, for example, attached to a print wiring board for instruments and the like in a car and is used for indicating notices concerning a safety belt or necessity for charging fuel. FIG. 1 is a side view. FIG. 2 is a plan view. FIG. 3 is a front longitudinal cross-sectional view. FIG. 4 is a part of a wiring board on which this lamp device L is installed.

In this figure, a reference 1 denotes a holder having a cylindrical shape with a bottom and made of electrically-insulating synthetic resin material such as 66 nylon resin similar to material used for forming a socket of a non-base lamp. This holder has an opened concave portion 11, and the outer circumferential side of this holder is provided with a ring-like flange portion 12 and a pair of engaging projecting portions 13 and 14 with a predetermined distance maintained from the upper surface of the flange portion 12. The engaging projecting portions 13 and 14 are positioned at an equal distance from the center of the holder 1, and these portions 13 and 14 are arranged so as to have different lengths or so as not to be situated in opposite positions (or not to form an angle of 180°, between each other). In addition, notch portions 15 are provided so as to extend to the concave portion 11 from the flange 12 through parts of the upper side wall.

In addition, the concave portion 11 contains a partition plate 31 dividing the inside and holding an LED (Light Emission Diode) lamp 2A, a wiring board 32 connected with an IC made of a semiconductor device a flickering circuit element and a transistor, i.e., a flicker IC 4 in this case, and with a diode 5 as a rectifying element for the LED lamp 2A, and a pair of first and second connecting members 6 and 7. Note that the LED lamp 2A has an envelope made of transparent synthetic resin, includes a serial circuit consisting of a chip section and a resistor, not shown, and emits light in red or green.

Leads 21 and 22 of the LED lamp 2A, the flicker IC 4, the diode 5, and the first and second connecting members 6 and 7 are connected in series through lands 33*a*, 33*b*, 33*c*, and 33*d* of the wiring board 32. In addition, the connecting members 6 and 7 described above are made of metal plates of brass or the like which has excellent electric conductivity and elasticity. The connecting members 6 and 7 comprise power supply terminal portions 62 and 72 standing on bottom portions 61 and 71 and obliquely extending outsides through the notch portions 15 formed in the side wall of the holder 1.

As for assembling of the lamp device L, components such as the LED lamp 2A, partition plate 31, wiring board 32, flickering IC 4, diode 5, and first and second connecting members 6 and 7 may be connected by soldering or caulking thereby to settle wiring, and thereafter, these components may be contained in the concave portion 11 of the holder 1 and fixed to portions of the partition plate 31 or may be fixed by inserting them into the partition plate 31 and the wiring board 32.

The lamp device L constructed as described above is attached to an installation hole 91 in a wiring board 9 as shown in FIG. 4. This wiring board 9 is made of an electrically-insulating synthetic resin plate, and the installation hole has a center hole 92 having a round shape substantially similar to the outer shape of the upper portion of the holder 1 and notches 93*a* and 93*b* of different lengths in two portions around the center hole 92, which are cut into shapes substantially similar to the outer shapes of the engaging projecting portions 13 and 14 of the holder 1 of the lamp device L to be attached.

Installation of the lamp device L onto the wiring board 9 as described above is carried out as follows. At first, the engaging projecting portions 13 and 14 are positioned with respect to the notches 93*a* and 93*b* of the installation hole 91 of the wiring board 9 and the lamp device L is pushed into the hole, thereby making the engaging projecting portions 13 and 14 pass the installation hole 91 and have a contact with the board 9. Next, the holder 1 is rotated in the clockwise direction such that the board 9 is inserted between the lower surfaces 13*a* and 14*a* (not shown) of the engaging projecting portions 13 and 14 and the upper surfaces of contact portions 63 and 73 formed on power supply terminal portions 62 and 72 projecting from the upper side of the flange portion 12. When the contact portions 63 and 73 have a contact with the wiring conductive members 94*a* and 94*b*, the rotation is stopped and thus, installation of the lamp device L is finished. (See the state shown in FIG. 1.) If the lower surfaces of the engaging projecting portions 13 and 14 are curved or slanted, the projecting portions 13 smoothly slide without biting into the surface of the wiring board 9 during the rotation of the holder 1.

Even if the positions of the engaging projecting portions 13 and 14 are positioned with respect to the notches 93*a* and 93*b* of the installation hole 91 with the portions 13 and 14 shifted by 180° C. from those described above, the engaging projecting portions 13 and 14 only have contacts with the periphery of the center hole 92 of the board 9 but the longer notch 14 cannot received by the shorter notch 93*a*, so that the holder 1 cannot be inserted.

Further, when a sensor (not shown) or the like detects abnormality, a current is made flow through the wiring conductive members 94*a* and 94*b*. Then, the current flows only in one direction, e.g., from the wiring conductive member 94*a*, to the power supply terminal portion 62 of the first connecting member 6, to the base plate portion 61 of the first connecting member 6, to the land 33*a*, to the diode 5, to the land 33*b*, to the lead 21 of the LED lamp 2A, to the chip portion (not shown) of the LED lamp 2A, to the lead 22 of the LED lamp 2A, to the land 33*c*, to the flicker IC 4, to the land 33*d*, to the base plate portion 71 of the second connecting member 7, to the power supply portion 72 of the second connecting member 7, and then, to the wiring conductive member 94*b*. The LED lamp 2A is thereby lightened. Note that the LED lamp 2A is not continuously lightened but is rendered intermittently conductive by the flickering IC 4 and thus flickers.

Preferably, the ON-OFF cycle (=flickering cycle of the lamp) of the flickering IC4 should be within a range of 0.5 to 10 Hz, for example, 2 Hz and the ratio of the ON-time to the OFF-time should be 50% or more to less than 50%, i.e., the turning-on time should be longer. From experiments made by the present inventors, it has been known that a lamp which flickers to be turned on for a longer time than the time turning off time biotechnologically provides a higher visibility and can attracts attention for a warning. Note that a preferable ON-OFF (flickering) cycle is 0.5 to 10 Hz and a preferable ON-OFF time ratio is 50 to 80%:20 to less than 50%.

Thus, the lamp device L is arranged such that a rectifying diode 5 and a flickering IC 4 are incorporated and integrated in a normal non-base type socket provided with an LED lamp 2A, and flickering of the lamp 2A is achieved by merely attaching and connecting the lamp device L to a wiring board which is provided with a circuit which is rendered conductive when abnormality is detected. In addition, erroneous connection of the LED lamp 2A as a light source having polarities can be prevented and secure electric connection is obtained by changing the sizes of the engaging projecting portions 13 and 14 formed on the holder 1. Further, a high warning attraction effect is obtained by appropriately choosing a flickering cycle, and thus, is effective to prevent accidents.

Hence, it is possible to provide a lamp device L which simplifies wirings of a flickering circuit on the device to attain advantages in view of costs, has a simple structure and a compact size, realizes easy attachment, and realizes flickering with an improved effect of attracting attention.

Figure 5:
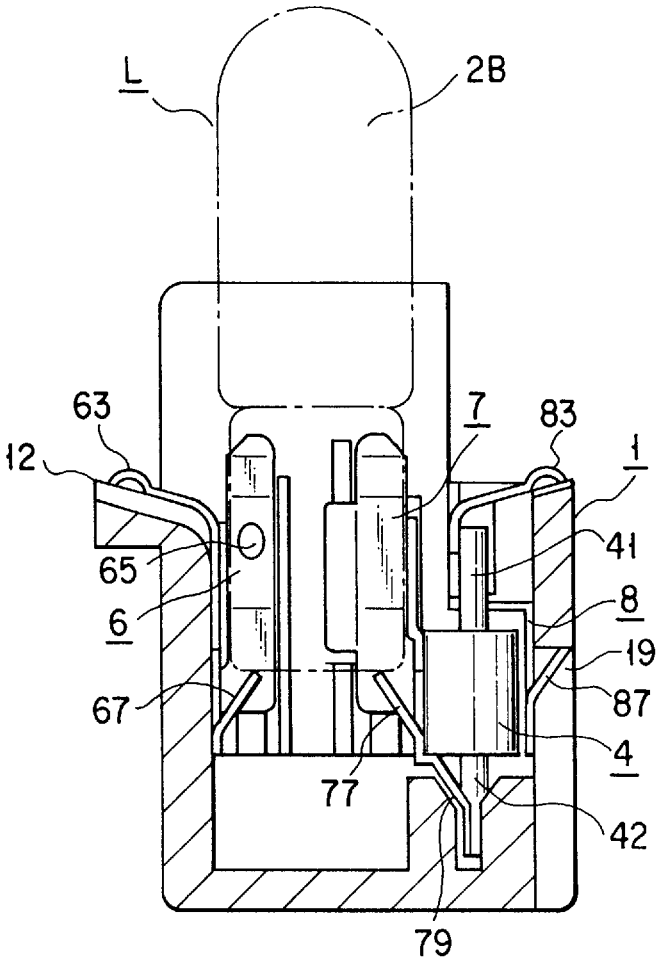
FIG. 5 is a longitudinal view showing a lamp device according to a second embodiment of the present invention.
Figure 6:
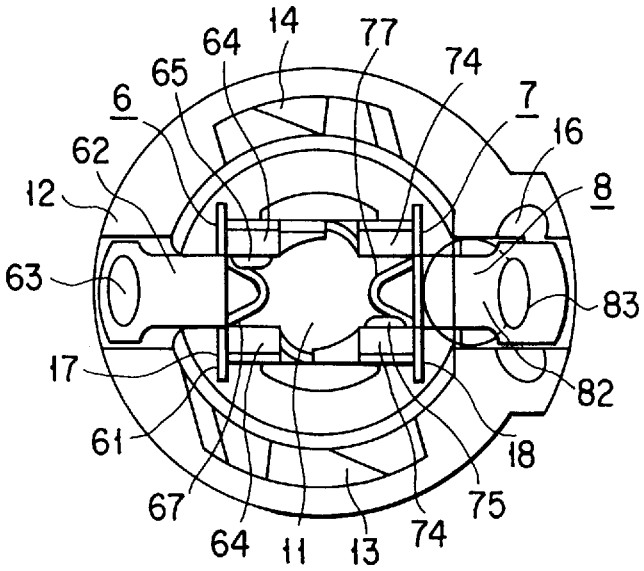
FIG. 6 is a plan view of the lamp device shown in FIG. 5.
Figure 7:
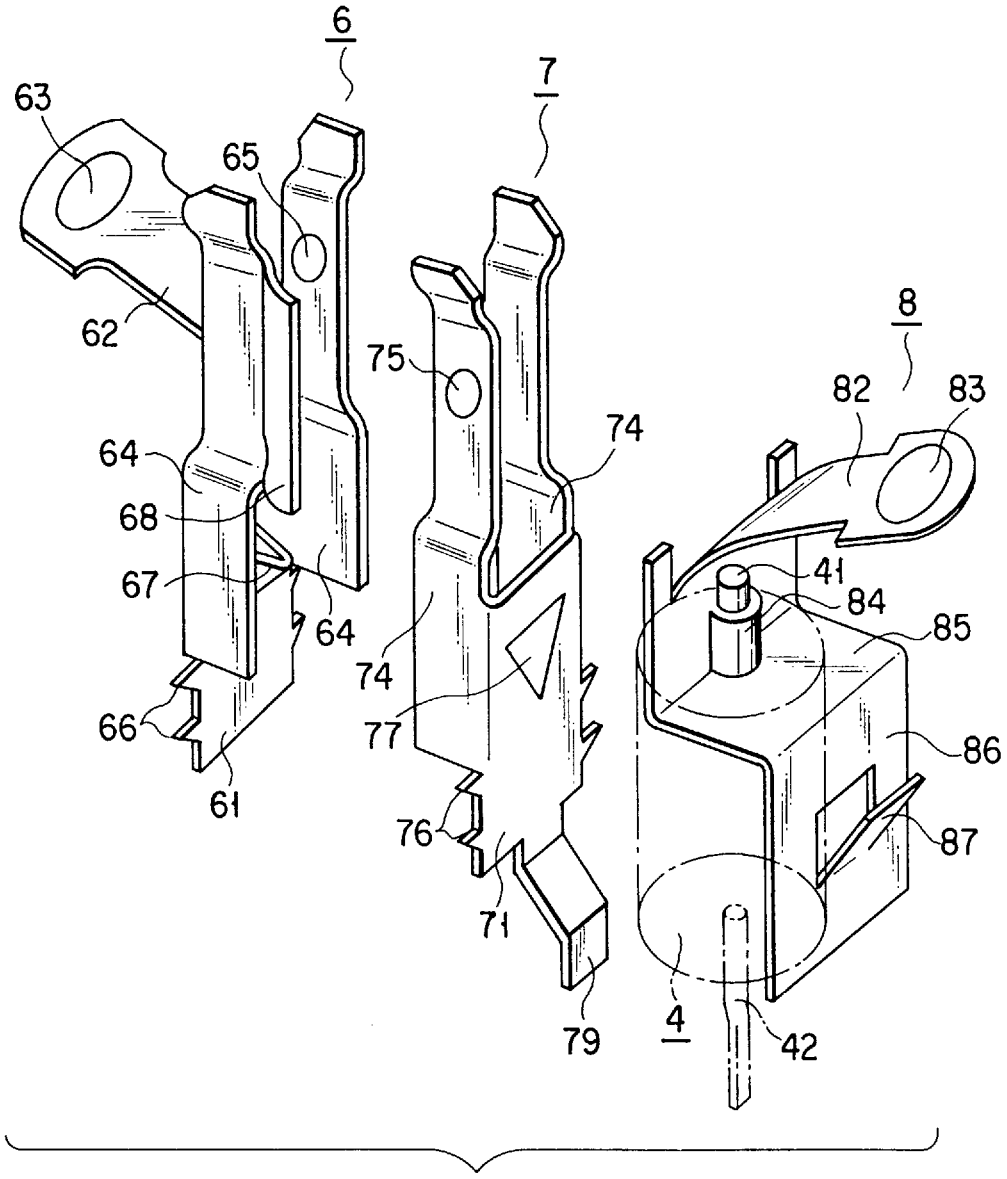
FIG. 7 is an exploded perspective view showing a connection member of a lamp shown in FIG. 5.
Figure 8:
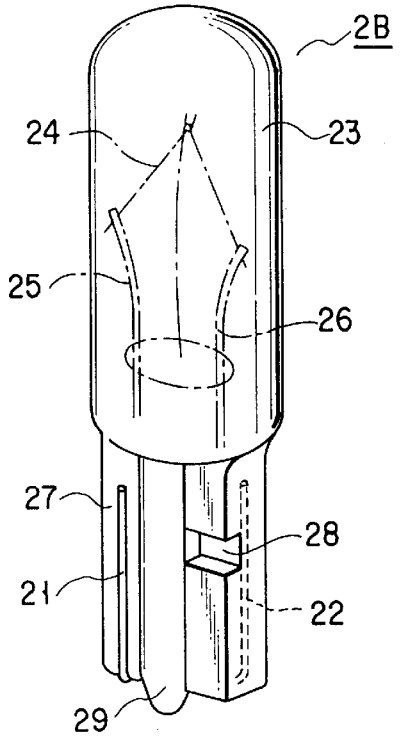
FIG. 8 is a perspective view of a wedge base type bulb of the lamp device shown in FIG. 5.

FIGS. 5 to 8 show a second embodiment of a lamp device L according to the present invention. FIG. 5 is a front longitudinal cross-sectional view. FIG. 6 is a top view. FIG. 7 is an exploded perspective view of a connecting member. FIG. 8 shows a light source of a small bulb of a wedge-base type. The same portions in these figures as those in FIGS. 1 to 4 are denoted by the same references, and explanation of those portions will be omitted herefrom.

This lamp device L has a bottomed cylindrical holder 1 in which first and second connecting members 6 and 7 for holding a wedge-base type bulb 2B are inserted in a concave portion 11 opened upward and a third connecting member 8 for connecting and holding a flickering circuit IC 4 as a flickering circuit element formed as a semiconductor device is inserted in a small concave portion 16 connected with the concave portion 11.

In addition, a projecting flange portion 12 and a pair of engaging projecting portions 13 and 14 are provided on an intermediate outer circumference of the cylindrical holder 1, such that the pair of projecting portions 13 and 14 are positioned with a predetermined distance maintained from the upper surface of the flange portion 12. Note that the pair of engaging portions 13 and 14 may have lengths equal to each other in case where the bulb 2B does not have polarities.

The first to third connecting members 6, 7, and 8 are made of metal plates, and the first connecting member 6 comprises clamp portions 64 which stand on a board 61 and are opposed to each other, and a power supply terminal portion 62 standing between the clamp portions and obliquely extending outwards. A center portion of the first connection member 6 has a lateral cross-section which is substantially U-shaped.

In addition, the second connecting member 7 has a shape substantially similar to the first connecting member 6 except that the power supply terminal portion 62 is removed from the member 6. The second connecting member 7 comprises clamp portions 74 standing on the base plate portion 71 and opposed to each other, and an electric conductive portion 79 formed by cutting a part of the base plate portion 71 so as to stand therefrom.

In the first and second connecting members 6 and 7, the pairs of clamp portions 64 and clamp portions 74 are bent such that the clamp portions of each pair are close to each other from their center portions to their upper portions. Projections 65 and 75 are provided for the clamp portions 64 and 74. In addition, a reference 46 denotes a contact portion formed by projecting the. top end portion of the power supply terminal portion 44, references 66 and 76 denote saw-teeth like projections projecting from the base plate portions 61 and 71, and references 67 and 77 denote stoppers formed by punching the base plate portions 61 and 71. References 68 and 78 denote guides extended from clamp portions 64 and 74.

In addition, the third connecting member 8 is bent. A power supply terminal portion 82 obliquely extended outward is provided at an upper portion of the member 8, and a groove 84 is provided at a vertical wall of the member 8. A stopper 87 is provided at a lower portions of bent portions 85 and 86.

Further, the first connecting member 6 is arranged such that saw-teeth-like projections 66 projected in both sides are hooked on longitudinal grooves of the insertion grooves 17 and therefore cannot be easily taken off when the base plate portion 61 is inserted into a member insertion groove 17 of the holder 1. In addition, the second connecting member 7 is stopped in the same manner as the first connecting member 6, when the base plate portion 71 is inserted into a member insertion groove 18.

In the third connecting member 8, one lead 14 of the flickering circuit IC 4 is pressed into a cut-stand portion 84 of an intermediate portion and is subjected to caulking if necessary. Thereafter, the third connecting member 8 is inserted into a small concave portion 16 of the holder 1. Then, the upper end of the stopper 87 opened upward is hooked on a through-hole 19 of the side wall of at a lower portion of the holder 1 and cannot be easily taken off. When the connecting member 8 is inserted, another lead 42 of the flickering circuit IC 4 has a contact with an electric conductive portion 79 formed on the base plate portion 71 of the second connecting member 7, thereby forming an electric connection.

In a wedge-base type bulb 2B installed on the first and second connecting members 6 and 7 in the holder 1, a pair of internal leads 25 and 26 connected with a filament coil 24 are contained in a glass bulb 23, as shown in FIG. 8, and an end of the glass bulb 23 is pinched by a pincher, thereby forming a pinch seal portion 27. Further, the pinch surfaces of the pinch seal portion 27 are additionally provided with external leads 21 and 22 connected to the internal leads 25 and 26, respectively. In addition, concave portions 28 (only one of which is shown in FIG. 8) are formed in the pinch surfaces of the pinch seal portion 27. A reference 29 denotes a gas discharge tube portion.

To hold the wedge-base type bulb 2B by means of the connecting members 6 and 7, the pinch seal portions 27 enter between the clamp portions 64 of the first connecting member 6 and between the clamp portions 74 of the second connecting member 7, which are bent to be close to each other, and concave portions 28 (only one of which is shown in the figure) formed in the pinch seal portions 27 are fit and engaged with projecting portions 65 and 75 formed on the clamp portions 64 and 74, by coupling of their concave and convex shapes. Simultaneously, the pinch seal portion 27 is clamped and pinched by clamping forces generated between the clamp portions 64 and between the clamp portions 74, so that the bulb 2B is rigidly held.

In addition, external leads 21 and 22 additionally provided on different pinch surfaces of the bulb 2B are respectively pinched against the clamp portions 64 and 74 of the connecting members 6 and 7, thereby forming an electric connection.

Further, the lamp device L constructed as described above can be flickered, like in the embodiment described above, when abnormality is detected after this device L is attached to the installation hole 91 of the wiring board 9 as shown in FIG. 4.

In this case, when abnormality is detected by a sensor (not shown) or the like, flickering of the bulb 2B is achieved as follows. A current flows from the wiring conductive member 84*a* of the wiring board 9 to the power supply terminal portion 62 of the first connecting member 6 to the base plate portion 61 of the first connecting member 6 to the clamping portion 64 of the first connecting member 6 to the external lead 21 of the bulb 2B to the internal lead 25 to the filament coil 24 to the internal lead 26 to the external lead 22 to the clamp portion 74 of the second connecting member 7 to the base plate portion 71 of the second connecting member 7 to the conductive portion 79 of the second connecting member 7 to the lead 42 of the flickering circuit IC 4 to the flickering IC 4 to the lead 41 of the flickering IC 4 to the power supply terminal portion 82 of the third connecting member 8 to the wiring conductive member 94*b*, and thus, the bulb 2B can be lightened intermittently.

Thus, since a flickering circuit IC 4 is incorporated and integrated in a normal non-base type socket provided with a wedge-base-type bulb 2B, the flickering circuit wiring of the device can be simplified. Therefore, it is possible to provide a lamp device L having a simple structure and a compact size, which can be easily attached and realize flickering display with a high effect of attracting attention.

Figure 9A:
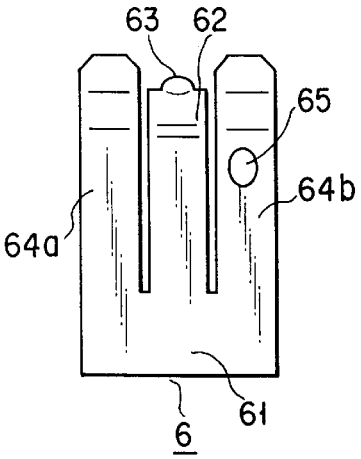
FIG. 9A is a front view of a first connection member of a lamp device according to a third embodiment of the present invention.
Figure 9B:
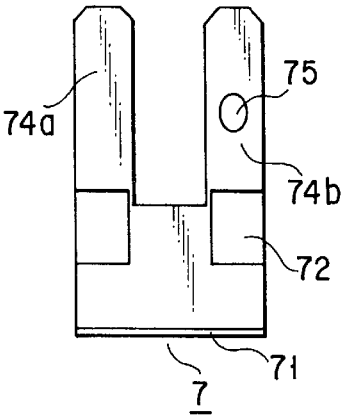
FIG. 9B is a rear view of a second connection member of the lamp device according to the third embodiment.
Figure 9C:
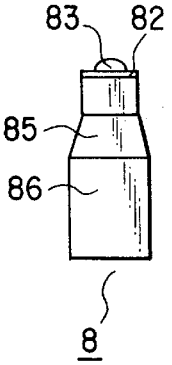
FIG. 9C is a rear view of a third connection member of the lamp device according to the third embodiment.
Figure 10:
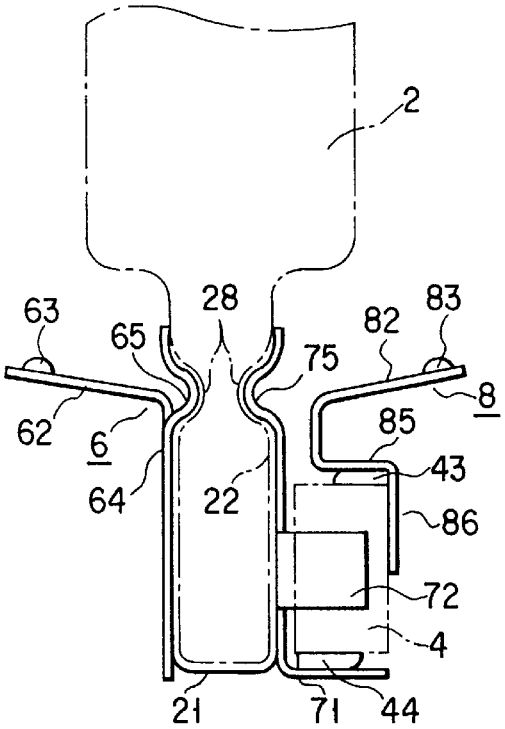
FIG. 10 is a side view showing an assembling state of the connection members shown in FIGS. 9A to 9C.

In addition, FIGS. 9A to 9C and FIG. 10 show a third embodiment of the lamp device L according to the present invention. FIGS. 9A to 9C show structures of respective connecting members and FIG. 10 is a side view of a main part where respective connecting members are combined. This embodiment adopts a wedge-base type bulb 2B shown in FIG. 8. The same portions as those shown in FIGS. 1 to 8 are denoted by the same references, and explanation of those portions will be omitted herefrom. In this lamp device L, the structure of the holding members 6, 7, and 8 for holding the wedge-base type bulb 2B is replaced with clamp portions 64 and 74 which have substantially U-shaped cross-sections and which hold the that the pinch seal portions 27 described above, so that the pinch surfaces are pinched from both sides to be held and obtain electric connection.

FIGS. 9A to 9C show first to third holding members 6 to 8, and FIG. 10 shows a state where the holding members 6 to 8 are combined. The first and second holding members 6 and 7 are shaped so as to press substantially the entire of pinch surfaces of a pinch seal portion of a bulb 2B, except for a gas discharge tube portion 29 slightly projected. The third holding member 8 has a shape substantially similar to that of the second embodiment. The first holding member 6 has comprises press (clamp) portions 64*a* and 64*b* standing on a base plate portion 61, at both ends of the member 6, and the second holding member 7 comprises press (clamp) portions 74*a* and 74*b* standing on a base plate portion 71, at both ends of the member 7. A power supply terminal portion 62 is provided so as to stand between the press (clamp) portions 64*a* and 64*b* of the first holding member 6. In addition, pieces 72 are continuously provided on the back surface of the second holding member 7 and are bent to hold a flickering circuit IC 4.

FIG. 10 is a side view where the holding members 6 to 8 are inserted in a holder (not shown), and projecting portions 65 and 75 formed on the press (clamp) portions 64*b* and 74*b* respectively enter and engaged into concave portions 28 formed in the pinch seal portion 27 of the bulb 2B, thereby preventing the bulb 2B from being taken off. Further, leads 21 and 22 added to the pinch surfaces of the pinch seal portion 27 have contacts with the press (clamp) portions 64*a* and 74*a*, thereby maintaining an electric conductivity.

The flickering IC 4 held by the second holding member 7 has a terminal 44 in contact with the base plate portion 71 of the holding member 7 and another terminal 43 in contact with an intermediate portion of the third holding member 8.

Specifically, in the lamp device thus constructed, holding of the bulb 2B and electric conductivity are obtained by clamping and pressing the pinch seal portion 27 from both of its front and rear pinch surfaces. The mechanical holding force and the electric connection are as excellent as those obtained in the embodiment described before.

Further, the lamp device L of this third embodiment attains the same operation and advantages as those obtained by the lamp device L of the embodiment described before.

Figure 11:
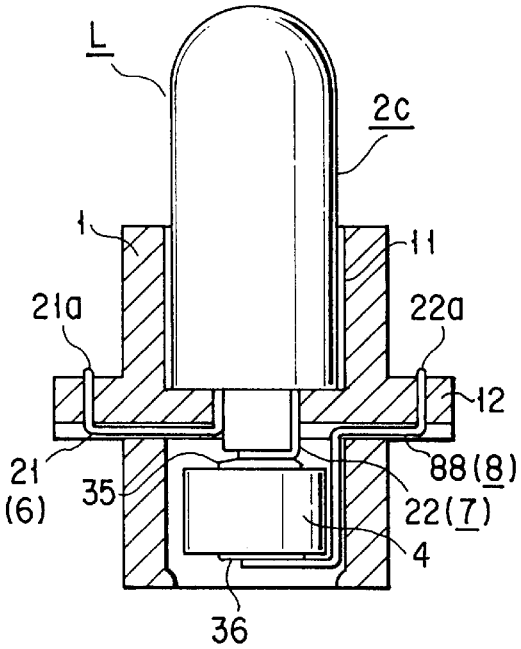
FIG. 11 is a longitudinal cross-sectional view of a lamp device according to a fourth embodiment of the present invention.
Figure 12:
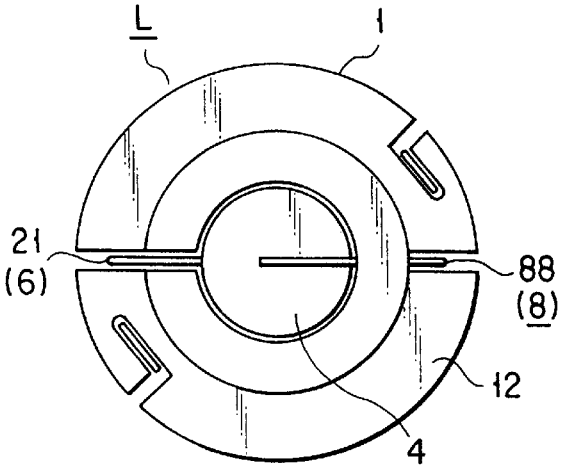
FIG. 12 is a bottom view of the lamp device shown in FIG. 11.

FIGS. 11 and 12 show a fourth embodiment of the lamp device L according to the present invention. FIG. 11 is a front longitudinal cross-sectional view and FIG. 12 is a bottom view. In this embodiment, a lamp device L uses a bulb 2C which is provided with no pinch seal portion 27 having a wedge-base shape and is sealed by means of bead sealing or diameter-reduction, or an LED which has an envelope of resin molding type and in which leads from end portions such as sealing portions constitute connecting members. Note that those portions which are same as those in FIGS. 1 to 10 are denoted by same references, and explanation thereof will be omitted herefrom.

In this lamp device L, for example, a small bulb 2C of a non-base type is inserted in a concave portion 11 opened at an upper portion of a cylindrical holder 1 having a bottom, and a flickering circuit IC 4 comprising terminal portions 35 and 36 each having a button battery shape is inserted in a concave portion lla at a lower portion with a partition wall 33 as a partition inserted. Further, a first connecting member 6 is formed such that one of a pair of leads 21 and 22 led from the ends of the bulb 2C is guided through a slit formed by cutting a side wall at a lower portion of the holder 1 and is wound around up to the flange portion 12.

A second connecting member 7 is formed such that another lead 22 passes through a through hole in the partition wall and is pressed and connected to a terminal portion 35 of the flicking IC 4. A third connecting member 8 is formed such that a lead connected to the latter terminal portion 36 of the flickering circuit IC 4 passes through a slit formed by cutting a side wall of a lower portion of the holder 1 and is wound around up to the upper surface of the flange portion 12.

When the lamp device L constructed in a structure as described above is attached to the wiring board 9, like in the embodiments described before, the connecting members 6 to 8 constituted by the leads 21, 22, and 88 constitute an electric conductance, and upper surfaces 21*a* and 88*a* of the leads 21 and 88 added on the upper surface of the flange portion 12 have contacts with wiring conductive members 94*a* and 94*b*, so that the bulb 2C can be securely rendered conductive and the same function and advantages as in the embodiment described before can be obtained.

Figure 13:
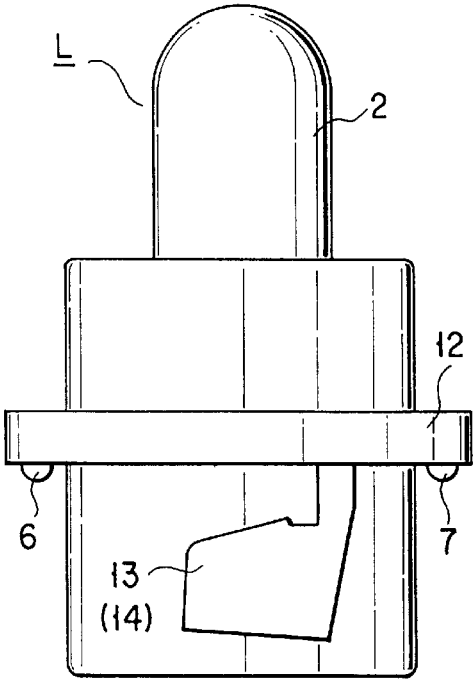
FIG. 13 is a plan view of the lamp device according to a fifth embodiment of the present invention.

In addition, FIG. 13 is a front view showing a fifth embodiment of a lamp device L according to the present invention. The same portion in this figure as those in FIGS. 1 to 12 are denoted by same references and explanation of those portions will be omitted herefrom. In the lamp device L shown in FIG. 13, a flange portion 12 is formed at an upper portion of a holder 1, and engaging projecting portions 13 and 14 are formed at a lower portion of the flange portion 12.

Figure 14A:
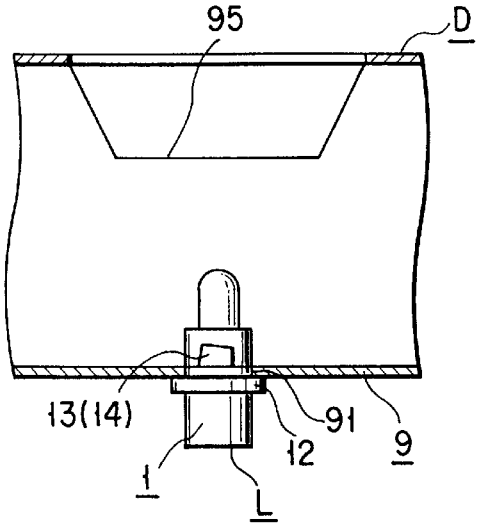
FIG. 14A and FIG. 14B are longitudinal cross-sectional views showing a part of a display device to which a lamp device of the present invention is attached.

Lamp devices L according to the above first to fifth embodiments are used in a display apparatus D such as a meter or the like for a car, as shown in FIG. 14A. This figure shows a display apparatus D in which a display panel 95 is provided above a wiring board 9 provided with various wirings, and an installation hole 91 is provided at a portion of the board 9 corresponding to a portion where an indication concerning a safety belt, for example. The lamp device L is attached into the installation hole 91.

If any one of persons in a car does not put on a safety belt after the car starts moving, a sensor or the like senses a safety belt not put on and a current is made flow through a put-on detect circuit of a lamp device L. Then, the lamp device L operates to make an LED lamp 2A, 2B, or 2C attached to a holder 1 flicker at a predetermined interval, so that a driver and passengers are notified of not-putting on a safety belt.

Thus, the display apparatus according to the present invention does not merely lighten a lamp but flickers to strongly and visually stimulate a person to attract his or her attention, and a warning thus issued suggests the person to put on a safety belt so that accidents can be reduced.

Figure 14B:
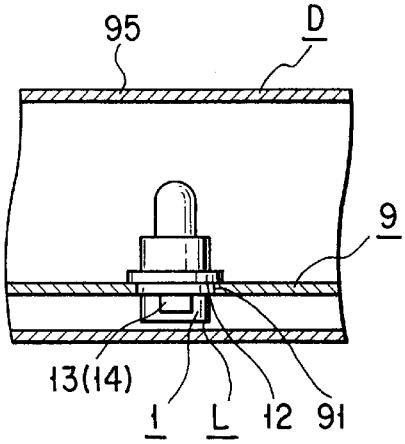

The lamp device L of the fifth embodiment shown in FIG. 13 can be adopted to perform predetermined display or warning even when any other lamp device L cannot be attached from the back side of the wiring board in a display apparatus D, as shown in FIG. 14B, or when the position of the lamp should be closer to the display panel 95.

Note that the present invention is not limited to the above embodiments. For example, outer shapes and sizes of the holder and the concave portion may be appropriately chosen in accordance with applications. As for connecting members, shapes of the holding portions and connecting terminal portions may be changed in accordance with shapes of the lamp and the flickering circuit element, or engaging means to be engaged with the holder may be changed appropriately. There is a case in which leads of the lamp, flickering circuit element, resistor, and rectifying element are hard materials having pin-like or rod-like shapes or soft materials which can be easily bent or are arranged in a leadless manner. In compliance with the types of leads, it is possible to appropriately change the shapes and structure of the terminal portions formed on the connecting members.

Further, the combination of a lamp and a holder is not limited to the embodiments described above, but may be arranged such that a bulb in place of an LED lamp is incorporated in the holder according to the first embodiment. (In case of a bulb, a rectifying element is not necessary.) On the contrary, an LED lamp in place of a bulb may be incorporated in a holder according to the second or fourth embodiment.

FIGS. 15 to 21B show a sixth embodiment of the present invention. In this embodiment, an LED as described above is used as a lamp. It is needless to say that the lamp or the light is not limited to an LED but any light source can be used.

Figure 15:
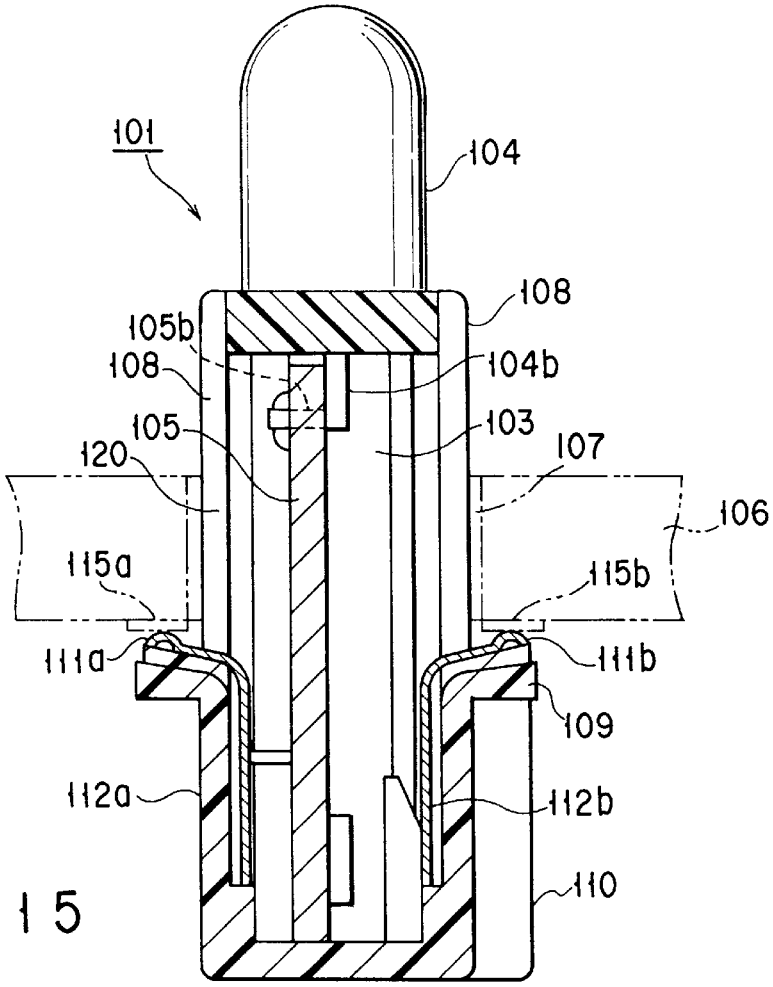
FIG. 15 is a longitudinal cross-sectional view showing a lamp device according to a sixth embodiment of the present invention.
Figure 16:
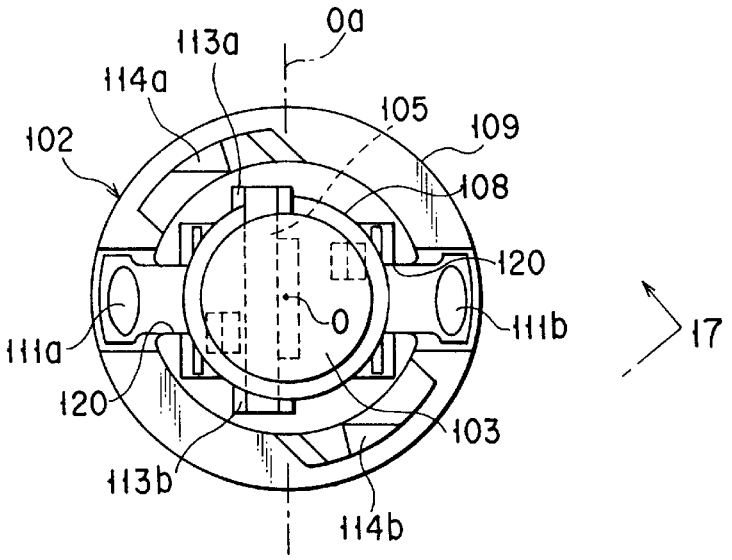
FIG. 16 is a plan view of the lamp device shown in FIG. 15.
Figure 17:
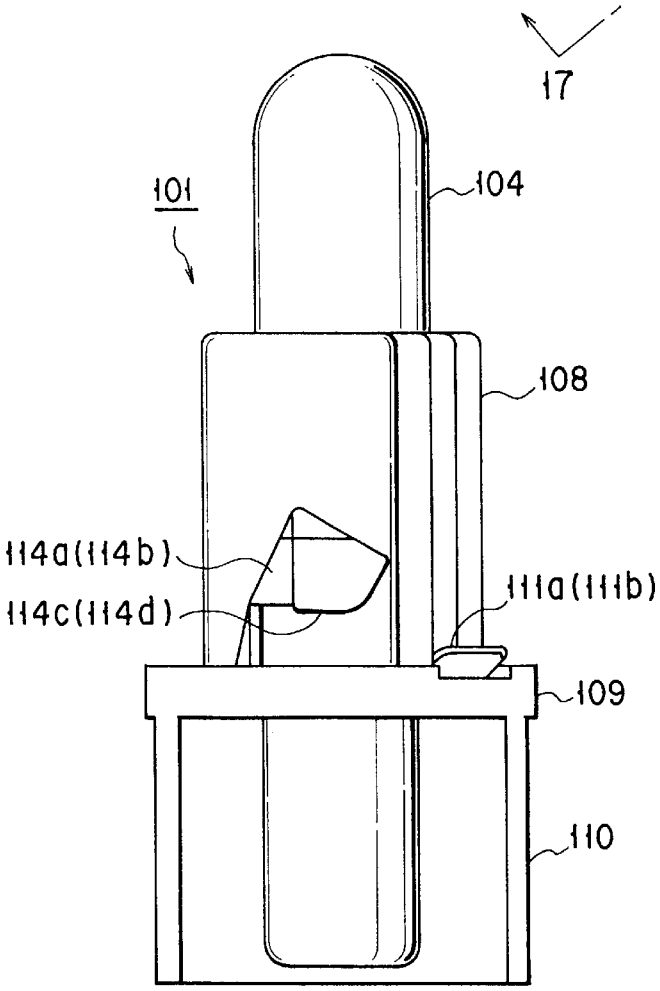
FIG. 17 is a side viewed from a direction indicated by an arrow 17—17 shown in FIG. 16.
Figure 18:
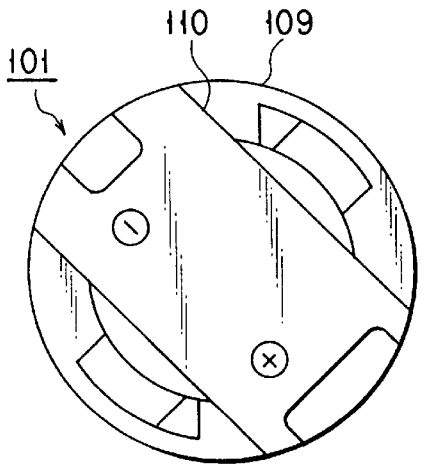
FIG. 18 is a bottom view of the lamp device shown in FIG. 15.

FIG. 15 shows a cross-section of a main part of a lamp assembly 101 according to the sixth embodiment of the present invention. FIG. 16 is a plan view of a body 102. FIG. 17 is a view from an arrow 17—17 of FIG. 16. FIG. 18 is a bottom view of FIG. 17. As shown in these figures, the lamp assembly 101 is fixed in a manner in which at least a base end portion of an LED 104 and a plate-like flickering circuit board 105 for flickering the LED 104 are inserted into an insertion hole 103 of the holder body 102 formed in a cylindrical shape with a bottom and made of electrically-insulating material such as 66 nylon resin or the like. The flickering circuit board 105 is provided with a flickering circuit and has a surface where circuit components are installed.

In the holder 102, an insertion cylinder portion 108 which is inserted in a circular insertion hole 107 of the print board 106 so as to project from one surface (i.e., from the upper surface thereof in FIG. 15) and a knob 110 integrally provided with an outward flange 109 having a larger diameter than the insertion cylinder portion 108 are coaxially and integrally formed in the axial direction.

Figure 20:
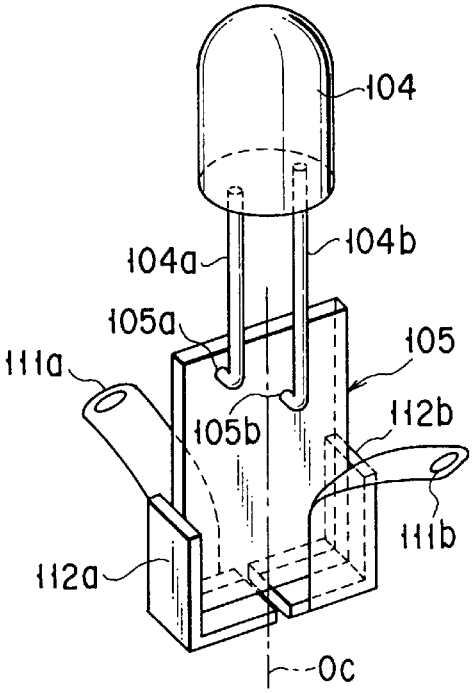
FIG. 20 is an exploded perspective view showing a lamp and a circuit board of the lamp device shown in FIG. 15.

On the outward flange 109, a pair of electrically-conductive contact terminals 111*a* and 111*b* are provided so as to oppose each other on a radial direction center axis which passes through a center 0 of the holder body 102 in a radial direction, and the contact terminals 111*a* and 111*b* have inner end portions 112*a* and 112*b* of which are fixed to both side surfaces of a flickering circuit board 105 by soldering or the like, thereby making electric connections, as shown in FIG. 20.

In addition, in the holder body 102, a pair of guide grooves 113*a* and 113*b* to be engaged with both end portions of a plate-like flickering circuit board 105 are provided in parallel in the axial direction on the inner surface of the insertion hole 103. The pair of guide grooves 113*a* and 113*b* are formed so as to oppose each other in the radial direction, at positions slightly shifted aside from the diameter direction center axis O.

On the outer side surface of the insertion cylinder portion 108 of the holder body 102, as shown in FIGS. 16 and 17, a pair of engaging portions 114*a* and 114*b* are provided and projected above the outward flange 109, at positions slightly shifted aside from the diameter center axis, so as to oppose each other with the insertion cylinder portion 108 inserted between each other.

Figure 19:
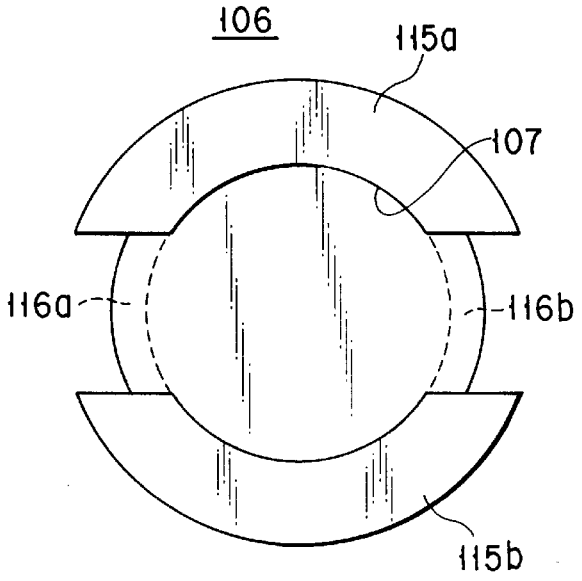
FIG. 19 is a plan view showing the shape of an insert hole of a print board into which the lamp device shown in FIG. 15 is attached.

Meanwhile, as shown in FIG. 19, an insertion hole 107 in which the insertion cylinder portion 108 is inserted is formed in a print board 106, and a pair of arc-like electrode portions 115*a* and 115*b* are formed on a surface (or the lower surface in FIG. 15) of the print board 106 in the periphery of the opening of the insertion hole 107, such that the electrode portions 115*a* and 115*b* are opposed to each other in the diameter direction. Engaging holes 116*a* and 116*b* in which a pair of engaging portions 114*a* and 114*b* of the holder body 102 are inserted are integrally formed between the electrode portions 115*a* and 115*b*.

FIG. 20 is an exploded perspective view showing a connection relationship between an LED 104 and a flickering circuit board 105. The LED 104 is fixed to the holder body 102 such that the base end surface of the LED is substantially in parallel with the upper end surface of the flickering circuit 105 in FIG. 20. Besides, installation holes 105*a* and 105*b* are formed in a surface of the flickering circuit board 105, at asymmetric positions in the lateral direction with respect to the axial direction center axis 0*c* of the board 105 as a center. Therefore, by previously setting polarities in correspondence with the positions of the installation holes 105*a* and 105*b*, the polarities can be confirmed with eyes.

Figure 21A:
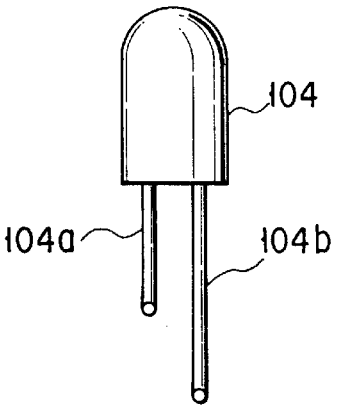
FIG. 21A is a plan view of an LED shown in FIG. 20.
Figure 21B:
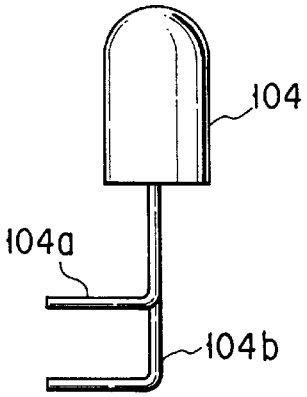
FIG. 21B is a side view of the LED shown in FIG. 20.

In addition, as shown in FIGS. 21A and 21B, the LED 104 has a pair of pin-like leads 104*a* and 104*b* projected outward from the base end portion and having minus and plus polarities, and the leads 104*a* and 104*b* have lengths different from each other in correspondence with distances to the installation holes 105*a* and 105*b* and are bent at substantially right angles.

Therefore, one lead 104*a* of the LED 104 can be inserted only in one installation hole 105*a* of the flickering circuit board 105, while the other lead 104*b* can be inserted only in the other installation hole 105*b*. It is therefore possible to perfectly prevent the LED 104 and the flickering circuit board 105 from being assembled with their polarities mistaken. Further, top end portions of leads 104*a* and 104*b* are inserted into the installation holes 105*a* and 105*b*, and the projecting end portions projecting from the back surface of the board 105 are fixed by soldering on the back surface of the flickering circuit board 105.

In addition, as shown in FIG. 20, inner end portions 112*a* and 112*b* of the pair of contact terminals 111*a* and 111*b* are previously fixed and electrically connected to the outer surface on both sides of the lower end portion of the flickering circuit board 105.

Therefore, the pair of leads 104*a* and 104*b* of the LED 104 are inserted in installation holes 105*a* and 105*b* of the flickering circuit board 105, such that the polarities of the holes correspond to the polarities of the leads, and are fixed thereto. Thereafter, the flickering circuit board 105 previously equipped with contact terminals 111*a* and 111*b* is engaged in the guide grooves 113*a* and 113*b* of the holder body 102 and is simply inserted in the insertion hole 107. Then, the pair of contact terminals 111*a* and 111*b* are arranged at predetermined positions outside the holder body 102.

Therefore, when a lamp assembly 101 is inserted in and fixed to the insertion hole 107 of the print board 106, the pair of contact terminals 111*a* and 111*b* of the lamp assembly 101 respectively have tight contacts with the pair of electrodes 115*a* and 115*b* of the print board 106, thereby forming an electric connection.

Further, in the situation in which the lamp assembly 101 is attached to the insertion hole 107 of the print board 106, as described above, the polarities of the pair of contact terminals 111*a* and 111*b* respectively correspond to the polarities of the electrodes 115*a* and 115*b*. Therefore, in case where one of the pair of electrodes 115*a* and 115*b* is positive, for example, the electrode 115*a* is positive, a current from this positive side flows first to one of the contact terminal 111*a* in contact with the positive electrode 115*a*, and thereafter, a current flows to a flickering circuit not shown of the flickering circuit board, to the lead 104*a*, to the LED 104, to the other lead 104*b*, to the other contact terminal 111*b*, and to the electrode 115*b* of the negative side of the print board 106, and thus, the LED 104 flickers.

Therefore, according to the present embodiment, it is possible to omit a step of inserting inner end portions 112*a* and 112*b* of contact terminals 111*a* and 111*b* into insertion holes of a flickering circuit board 105 to constitute an electric connection after a LED 104 is assembled on a flickering circuit board 105, unlike in the prior art technique. The assembly steps can thus be reduced.

Further, since both side end portions of the flickering circuit board 105 are engaged in a pair of guide grooves 113*a* and 113*b* to guide insertion of the holder body 108 into the insertion hole 103, shaking of the flickering circuit board 105 in the insertion hole 103 can be reduced and insertion of the board 105 into the insertion hole 103 can be carried out easily and rapidly.

Besides, the pair of guide grooves 113*a* and 113*b* are arranged so as to oppose each other at positions slightly shifted aside from the diameter direction center axis 0a of the holder body 102. Therefore, if the polarities of the flickering circuit board 105 are mistaken, e.g., if the flickering circuit board 105 is inserted in the pair of guide grooves 113*a* and 113*b* with the board inverted, inversion of the board can be identified in comparison with a situation in which the polarities are correctly settled, when one surface of the flickering circuit board 105 is viewed from the diameter direction center axis 0*a* of the holder body 102. Polarities can thus be checked with eyes. Accordingly, it is possible to previously prevent the flickering circuit board 105 from being incorrectly assembled into the holder body 108.

In case where the lamp assembly 101 thus assembled is incorporated in a print board 106 to constitute a display apparatus for a car-mount meter, a warning lamp, or the like, the LED 104 and the insertion cylinder portion 108 of the holder body 102 are inserted in the insertion hole 107 of the print board 106 shown in FIG. 19, from the lower side, and a pair of engaging portions 114*a* and 114*b* of the holder body 102 are adjusted so as to correspond to positions of a pair of engaging holes 116*a* and 116*b*. Since the pair of engaging portions 114*a* and 114*b* are shifted aside from the diameter direction center axis 0*a* of the holder body 102, the polarities of the pair of electrodes 115*a* and 1115*b* of the print board 106 do not correspond to the polarities of the pair of contact terminals 111*a* and 11*b* of the holder body 102, if the engaging portions do not correspond to the engaging holes 116*a* and 116*b*. In this case, the engaging portions 114*a* and 114*b* cannot be inserted in the engaging holes 116*a* and 116*b*.

Therefore, if the pair of engaging portions 114*a* and 114*b* of the holder body 102 are adjusted so as to correspond to the positions of the engaging holes 116*a* and 116*b* of the print board 106 and a knob 110 of the holder body 102 is rotated by a predetermined angle around the axis, the periphery of the opening of the insertion hole 107 of the print board 106 is engaged in opening portions 114*c* and 114*d* of the engaging portions 114*a* and 114*b*, and the pair of contact terminals 111*a* and 111*b* have tight contacts with the pair of electrodes 115*a* and 115*b* on the lower surface of the print board 106 in the figure, thereby constituting an electric connection with their polarities made correctly correspond to each other. Therefore, the print board 106 are clamped between the pair of electrodes 115*a* and 115*b* and between the pair of engaging portions 114*a* and 114*b*, and thus coupled securely. As a result of this, the LED 104 is electrically connected to a desired electric circuit of the print board 106, through a pair of leads 104*a* and 104*b*, a flickering circuit board 105, inner end portions 112*a* and 112*b*, contact terminals 111*a* and 11*b*, and electrodes 115*a* and 115*b*, so that light emission of the LED 104 is controlled and a target object to be illuminated, such as a gauge of a car-mount meter, is illuminated.

In addition, a LED 104 has a long life-time, a high luminance, an excellent cold resistance, and also, an excellent heat resistance, so that a display apparatus can have an improved free-maintenance characteristic.

In addition, in the lamp assembly of this embodiment, the flickering circuit board 105 is contained in an insertion cylinder portion 108 projected from the holder body 102, and a pair of expanding slot portions 120 which allows the above-mentioned contact terminals 111*a* and 111*b* to pass during assembly are formed in the circumferential wall portion of the insertion cylinder portion 108.

Since the insertion cylinder portion 108 is thus projected, this portion 108 itself excellently radiates heat, and the pair of expanding slots 120 provide excellent internal ventilation. Therefore, the flickering circuit board 105 equipped with electronic components such as ICs and the like is contained in the insertion cylinder portion 108, and therefore, excellent heat radiation is achieved.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A lamp device having a lamp and a holder, which is mechanically and detachably engaged and held in an installation hole formed in an installation member of a print board thereby forming an electric connection, comprising:

the holder made of insulating material;

a flange portion and at least one pair of engaging projection portions, formed on an outer portion of the holder;

at least two connecting members each having at least one part guided onto the flange portion, for electrically connecting a circuit on the installation member with the lamp; and a flickering circuit contained in the holder and electrically inserted between the connecting members and the lamp, for flickering the lamp.

2. A lamp device according to claim 1, wherein the holder includes a portion for containing a base end portion of the lamp, and a portion for containing the flickering circuit.

3. A lamp device according to claim 1, the lamp including a pinch seal portion having a first side and a second side, wherein the holder comprises:

a first connecting member having a clamp portion for mechanically stopping the first side of the pinch seal potion of the lamp and forming an electric connection, and a power supply terminal portion extended above the flange portion;

a second connecting member having a clamp portion for mechanically stopping the second side of the pinch seal portion of the lamp, and a conductive portion formed to be continuous to the clamp portion and have an electric connection with a terminal of the flickering circuit element; and a third connecting member having an electric connection with another terminal of the flickering circuit element and having a power supply terminal portion extended to above the flange portion.

4. A lamp device according to claim 3, wherein each of the first and second connecting members has a clamp portion having a substantially U-shaped lateral cross-section, for clamping and holding the pinch seal portion of the lamp from both sides.

5. A lamp device according to claim 3, wherein the clamp portion of the first connecting member has a contact with the first side of the pinch seal portion of the lamp and the clamp portion of the second connecting member has a contact with the second side of the pinch seal portion.

6. A lamp device according to claim 1, wherein the flickering circuit element is constituted by an IC.

7. A lamp device according to claim 1, wherein the flickering circuit element is constituted by a transistor.

8. A lamp device according to claim 1, wherein the lamp is an incandescent lamp.

9. A lamp device according to claim 1, wherein the lamp is an LED lamp and the flickering circuit is provided with a resistor element for flickering the LED lamp.

10. A lamp device according to claim 1, wherein the lamp is an LED lamp including a resistor.

11. A lamp device according to claim 9, wherein a chip portion and the flickering circuit element are integrated in the LED lamp.

12. A lamp device according to claim 1, wherein the flickering circuit makes the lamp flicker at a cycle of 0.5 to 10 Hz and a turning-on time for which the lamp is turned on is longer than a turning-off time for which the lamp is turned off while the lamp is flickered cyclically.

13. A lamp device according to claim 1, wherein the at least one pair of engaging projecting portions are arranged at asymmetric positions on a concentric circle with respect to a center axis line of the holder.

14. A lamp device according to claim 1, wherein the at least one pair of engaging projecting portions have shapes different from each other.

15. A lamp device according to claim 1, wherein the lamp is an LED lamp and a flickering circuit board including the flickering circuit is installed on a base end portion of the LED, such that the flickering circuit board is inserted in the holder, a pair of installation holes are formed on the flickering circuit board and a pair of leads of the LED are inserted in the installation holes thereby constituting mechanical installation and an electric connection, such that the pair of installation holes are arranged at asymmetric positions with respect to a center axis line of the flickering circuit board, and an insertion hole in which the flickering circuit board and at least the base end portion of the LED are inserted is formed in the holder , and a plurality of guide grooves for guiding insertion of the flickering circuit board are formed in an inner surface of the insertion hole, such that the guide grooves are arranged at asymmetric positions deviated aside with respect to a diameter crossing a center of the insertion hole.

16. A lamp device according to claim 15, wherein the at least pair of engaging projecting portions are arranged at asymmetric positions deviated aside from a diameter crossing a center of an installation hole of an installation member to which the lamp device is attached.

* * * * *